United States Patent [19]

LaBarre

[11] Patent Number: 4,998,856

[45] Date of Patent: Mar. 12, 1991

[54] MOTOR VEHICLE PARKING INSTALLATION, FORMING AN AUTOMATIC INDIVIDUAL GARAGE IN AN URBAN ENVIRONMENT

[76] Inventor: Andre E. LaBarre, 6, rue du Mont-Perdu, 31200 - L'Union, France

[21] Appl. No.: 367,209

[22] Filed: Jun. 16, 1989

[30] Foreign Application Priority Data

Apr. 18, 1989 [FR] France ..... 89 05136

[51] Int. Cl.[5] ..... E04H 6/06

[52] U.S. Cl. ..... 414/240; 414/243; 414/263; 414/286

[58] Field of Search ..... 414/231, 252, 253, 255, 414/256, 258, 259, 260, 263, 286, 267, 277, 233, 234, 235, 239, 240, 241, 242, 243, 244, 245, 246; 108/156, 159

[56] References Cited

U.S. PATENT DOCUMENTS

| | | | |
|---|---|---|---|
| 2,670,860 | 3/1954 | Cogings | 414/253 X |
| 3,125,235 | 3/1964 | Frangos | 414/239 |
| 3,217,905 | 11/1965 | Frangos | 414/239 |
| 3,294,260 | 12/1966 | Frangos | 414/256 X |
| 3,414,141 | 12/1968 | Rougemont | 414/252 X |
| 3,497,087 | 2/1970 | Vita | 414/252 |
| 3,845,717 | 11/1974 | Alimanestianu | 414/252 X |
| 3,944,085 | 3/1976 | Obregon | 414/231 |
| 4,322,804 | 3/1982 | Evans | 414/231 X |
| 4,673,326 | 6/1987 | Halonen et al. | 414/286 |
| 4,778,324 | 10/1988 | Sawyer | 414/252 X |

FOREIGN PATENT DOCUMENTS

| | | | |
|---|---|---|---|
| 2183619 | 6/1987 | United Kingdom | 414/253 |
| 1128115 | 3/1960 | Fed. Rep. of Germany | 414/264 |
| 2574380 | 6/1986 | France | 414/287 |
| 63-262306 | 10/1988 | Japan | 414/231 |
| 248789 | 8/1987 | U.S.S.R. | 414/286 |

*Primary Examiner*—David A. Bucci
*Assistant Examiner*—Robert S. Katz
*Attorney, Agent, or Firm*—Lackenbach, Siegel, Marzullo & Aronson

[57] ABSTRACT

The invention provides a motor vehicle parking installation forming an automatic individual garage in an urban environment. In this installation, the vehicle carrying platform (2) has two longitudinal edges (25) with a V shaped inclined profile cooperating by bearing on two retractable longitudinal stop elements (29) mounted along the hopper opening (3).

3 Claims, 3 Drawing Sheets

Figure 1:
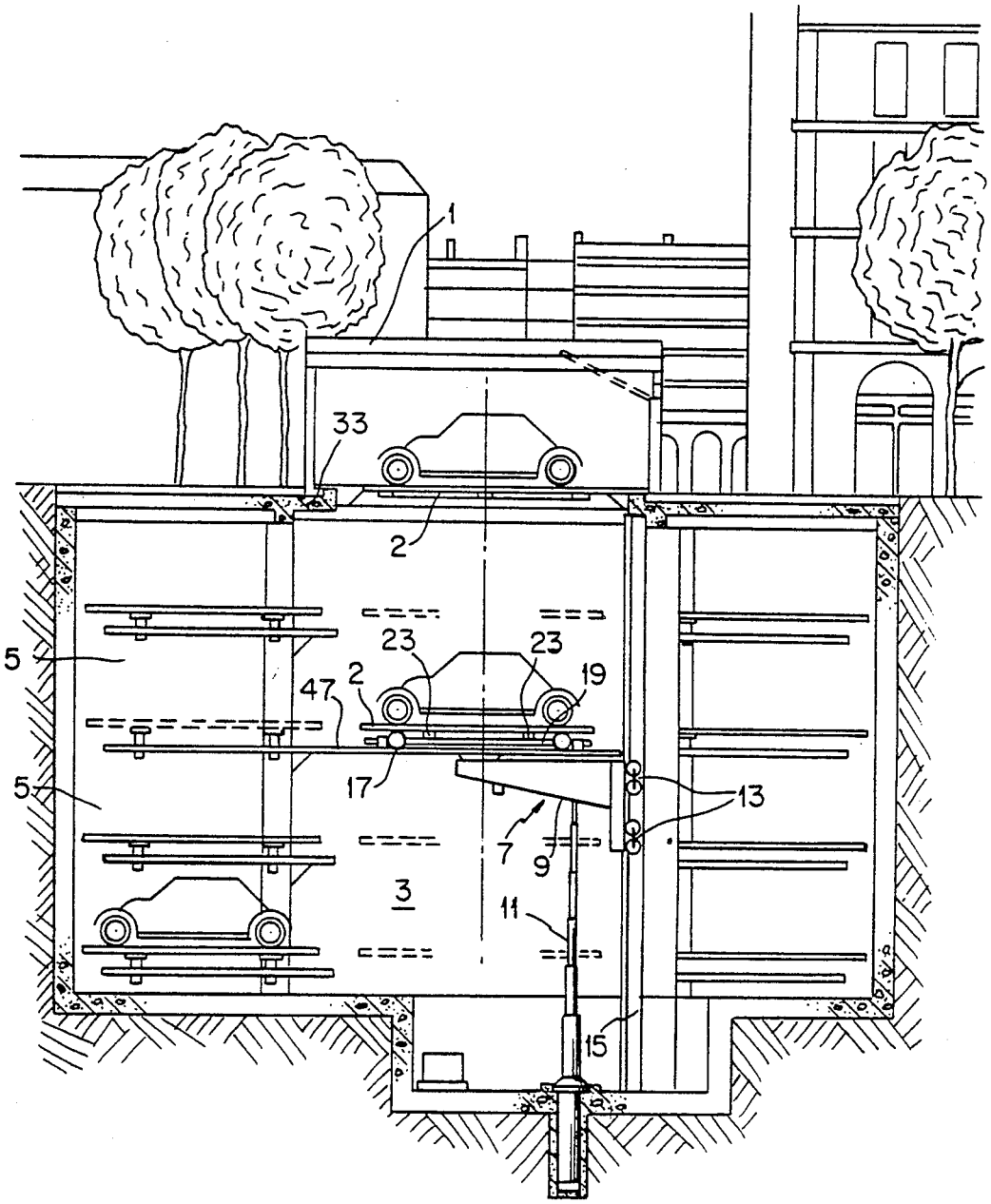

MOTOR VEHICLE PARKING INSTALLATION, FORMING AN AUTOMATIC INDIVIDUAL GARAGE IN AN URBAN ENVIRONMENT

The present invention relates to improvements to the vehicle parking installations of the type described in FR 2 586 443 relating essentially to a motor vehicle parking installation forming an automatic individual garage in an urban environment. It relates more particularly to the vehicle carrying platform as well as the assembly of associated means concerning the safety of its movement.

It will be recalled that the object of this patent is a vehicle, particularly motor vehicle, parking installation, characterized in that it comprises:

- a common entrance in the form of a closed garage equipped with an automatic door and a control for fetching and parking said vehicles,
- a group of individual parking places situated in a space available in the vicinity of said common entrance and intended for parking respectively each of said vehicles,
- an assembly of independent vehicle supporting platforms, respective supports for each of said vehicles and
- a system for transporting said vehicle supporting platforms capable of moving a selected platform from said entrance, as a function of said control, for depositing a vehicle or receiving it to bring it into a respective parking place,
- said control only being able to be operated by authorized users.

The vehicle carrying platforms, such as they are called at present, have in fact an essential role. They must correctly receive the vehicle to be parked in all safety and they must be moved and deposited precisely, reliably and perfectly reproducibly in their respective parking place.

The present invention relates then, for the above purpose, to the elements proper to the vehicle carrying platform as well as the kinematic means for its reliable movement.

The vehicle carrying platform constitutes the bottom forming the floor of the individual garage or box receiving the vehicles, when the installation is not operated. This platform is moved during operation by the transport system of the installation, which is essentially formed of a lifting console moving a rotary platform with its transfer carriage, guided vertically along a vertical post by rolling on rollers. The lifting console supporting the rotary platform is raised by a central jack extending over the whole depth of the hopper where the vehicle parking places are located, which are in a radial configuration in the hopper.

The first function concerned is that where the platform forms the bottom of the box when not in operation. To ensure and protect this function, the vehicle carrying platform of the present application, having an essentially rectangular shape and of a format corresponding substantially to the ground dimensions of usual motor vehicles, is essentially characterized in that its two longitudinal edges have a slanted profile in the form of a V and cooperate by bearing on two retractable longitudinal stop elements mounted along the hopper opening closed by said platform.

Said stop elements are advantageously elements in the form of L-shaped floor bolts whose essentially flat head cooperates with the external V profile of the platform. These elements are articulated to the hopper opening, to each of the longitudinal hopper beams and are driven by a jack. In the operating position, they are rotated with their head bearing on the V profile of the platform and in the inoperative or retracted position, they come right against the opening so as to occupy a vertical position out of range of said profile, allowing the platform to descend.

This arrangement with articulated floor bolts cooperating on the V profile of the platform makes it possible to obtain absolutely perfect self-locking of the platform on the hopper opening. Furthermore, from the mechanical point of view, it is also excellent since it transfers all the vertical forces to the concrete floor about the hopper opening, this floor thus working under compression.

The platform has been completed on the surface, in order to provide safety of reception of the vehicles, with two raised longitudinal edges defining the track for introducing the vehicles. The thus channelled vehicle is further displayed by cameras disposed orthogonally on the maximum height gauge not to be exceeded. If one of the parts of the vehicle introduced exceeds the gauge, the system stops as a safety precaution. In the second aspect of the application concerning the safety of movement of the platform, two means have been provided for locking the movement, which are indispensable for without them the system cannot operate. Between the vehicle carrying platform and the rotary platform is located an intermediate element which is the transfer carriage on which the vehicle carrying platform is laid. In order to secure the vehicle carrying platform firmly to the rotary platform, a first locking means has been provided in the form of engagement of a vertical finger in a complementary housing formed in the rotary platform. This finger may be fixed to the transfer carriage, so as to move vertically and in a controlled fashion. Thus, the carrier platform and so the vehicle cannot accidentally move out of position during the vertical translation of the system.

This same finger may be used for very accurately positioning the carrier platform in its parking place, by indexing itself also to a complementary housing fixed thereon.

This means further ensures the reproducibility of the horizontal and translational travel paths and so positioning of the carrier platform.

The second safety means consists in locking the vertical and rotary positioning of the rotary platform at a recognized selected position, for example by a landing bolt or movable horizontal finger fixed to the rotary platform and cooperating with a housing suitably provided at the parking place to allow the transfer carriage to move over its guides. This bolt is completed by a contact element for recognizing the correct operation of the system.

Thus, the transfer carriage with its platform cannot be removed unless authorized.

Figure 2:
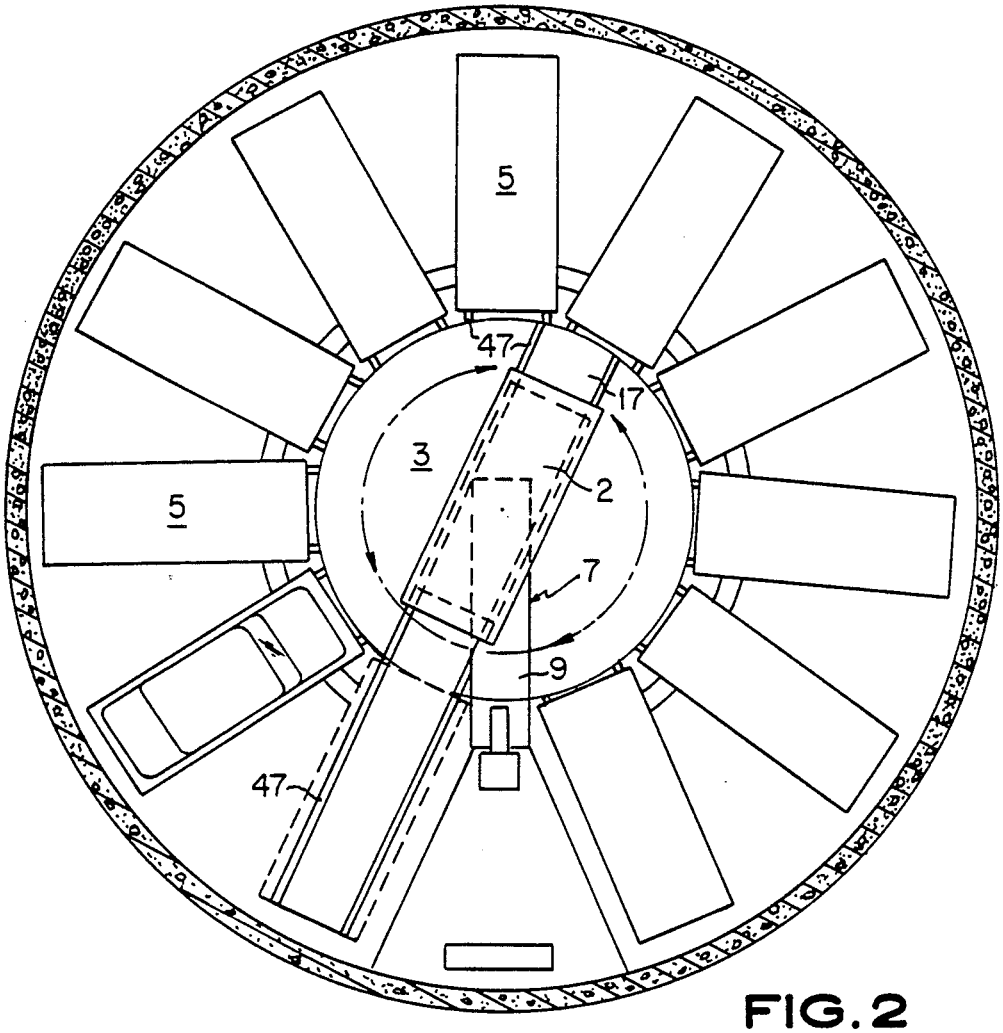
Figure 3:
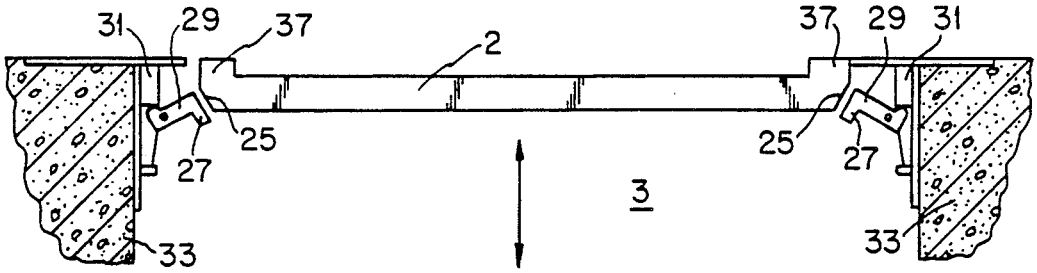
Figure 4:
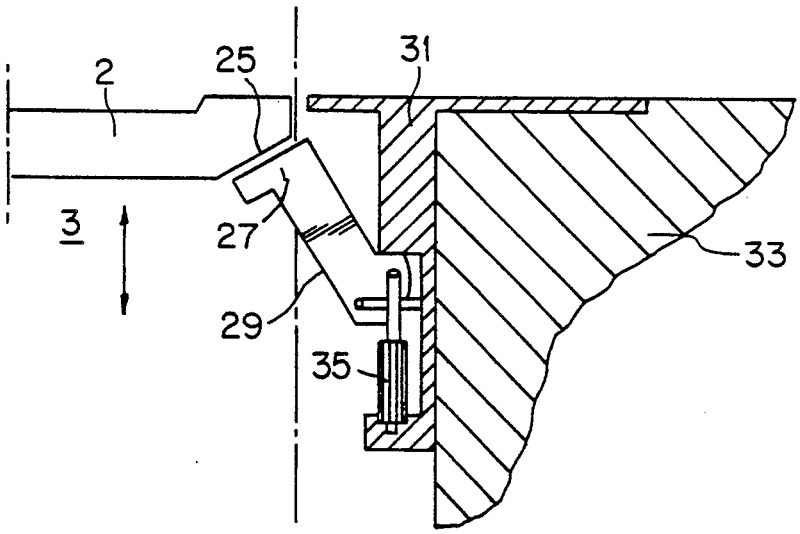
Figure 5:
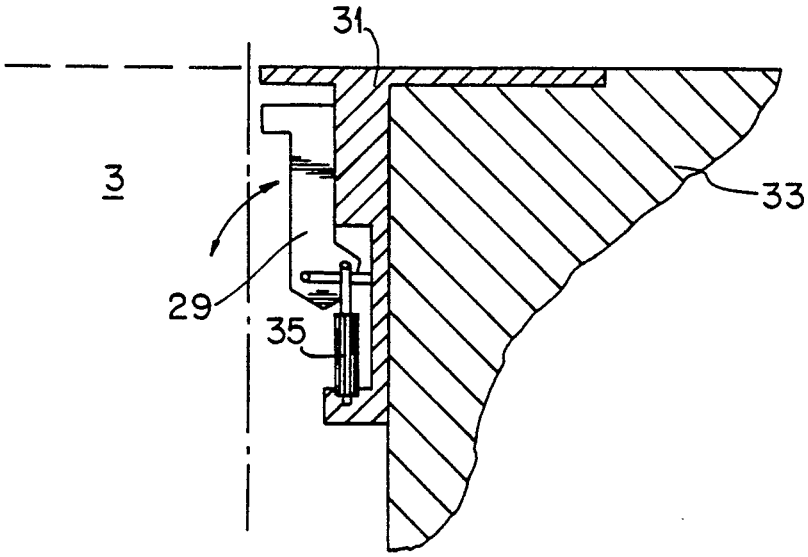

The different aspects and advantages of the invention will be explained hereafter by means of embodiments with reference to the accompanying drawings in which:

FIGS. 1 and 2 show schematically one embodiment of the parking installation in accordance with the above mentioned patent, respectively in lateral cross section and in a plan view and, relatively to the application FIG. 3 is a cross sectional view of the vehicle carrying platform, FIGS. 4 and 5 show the bolt of the floor supporting the platform at the hopper opening, respectively in the operative and inoperative (retracted) positions, FIGS. 6 and 7 are variants of the platform raising system, still for providing increased safety of movement of the platform.

A preferred embodiment of the parking installation according to the above mentioned patent is recalled in FIGS. 1 and 2. It comprises a reception box 1, whose bottom is closed when not operated by a vehicle carrying platform, an underground hopper with its different vehicle parking places 5 in a radial configuration, the transport system 7 with the lift 9 or lifting console driven by a jack 11 and guided laterally by rollers 13 on a vertical post 15. On the lift 9 is disposed the rotary platform 17 and its associated transfer carriage 19, the purpose of which is to move the vehicle carrying platforms 2 as far as the selected parking places 5. Platform 2 is essentially flat, carried by the transfer carriage 19 at four points and more precisely by four jacks 23 suitably disposed in a rectangle on the inner surface of the platform 2 and secured vertically to the carriage 19. The platform comprises (FIG. 3) two longitudinal edges 25 turned towards the hopper and defining a V profile and able to bear on the upper heads of two longitudinal L-shaped floor bolts 29 articulated to the longitudinal beams 31 joining the concrete slab 33 defining the hopper opening. These bearing points transfer the vertical forces (weight) of the platform to the concrete slab and cause it to work under compression, so suitably. These bolts 29 are actuated by a simple jack 35 (FIG. 4) and come into a retracted vertical position just before operation of platform 2 and more precisely just after the platform has been slightly raised to release the bolts.

Platform 2 also comprises, as can be seen in FIG. 3, two raised longitudinal edges 37 defining the path for the vehicle to be dealt with. As mentioned above, edges 37 or the periphery may serve as reference for the sighting lines, of a camera (not shown), which define the maximum permitted longitudinal gauge of the vehicles.

In operation, platform 2 of the box, positioned on its floor bolts is taken up by the transport system 7, raised slightly then lowered after withdrawal of bolts 29, to the desired level. It rests on the transfer carriage 19. The rotary platform 17 is turned facing the selected parking place 5, guides 47 of the transfer carriage being in continuity on the parking place. At this time, the horizontal transfer may be carried out; the transfer carriage 19 raises the platform 2 slightly by means of the four jacks 23 then rolls over its guides 47 into the selected parking place, carrying the platform as far as its approximate setting down position. A mobile finger of the carriage 19 then engages in a complementary housing defining the exact position at which the platform is set down in the parking place. The platform is then lowered on to the parking place, still by means of jacks 23, and the carriage thus released may be withdrawn in the reverse direction, also using position locking of the carriage and the rotary platform.

It will be noted in the variant of FIGS. 6 and 7, relating to the movement of the carrier platform 2, that the vertical movement may be provided by means of a device with a lifting frame comprising four arms (at least three) coupled at their end by a transmission box 53 to the vertical racks 55 of corresponding carrier posts 57 (some of those of the hopper). These boxes operated to maintain the platform horizontal. This device, with respect to the single vertical central actuating jack 11, by multiplying the vertical actuators further reduces the probability of failure, which is the source of accidents, in the vertical movement of the vehicle carrying platform. This device may be further coupled in redundancy or in an emergency with the central jack actuation.

Finally, control of the movement of said elements, namely floor bolts, aprons, camera display, landing bolt and translation index, will be provided by an automatic device controlling the whole of the system, itself possibly connected to a central data processing display and monitoring station.

I claim:

1. In an automobile storage system, an automobile supporting system for supporting an automobile at a vertical entrance to an elevator, said supporting system comprising:

a platform of rectangular shape having a size sufficient to support an automobile and having two upwardly turned longitudinal end sections which are angularly tapered at their bottom corners to form platform supporting surfaces;

four retractable L-shaped floor bolts pivotally mounted at said entrance and arranged in a rectangular pattern peripherally adjacent said end sections, said L-shaped bolts comprising an elongated leg and a transverse base leg having a bearing face, said bolts are movable between a retracted position which allows said platform to pass through said entrance and an extended position which supports said platform with their bearing faces arranged adjacently parallel said platform supporting surfaces to respectively contact the platform supporting surfaces and thereby support the platform;

four adjustable jacks engaged respectively to said four Lshaped floor bolts for pivotally moving said L-shaped floor bolts between said retracted position and said extended position; and vertical displacement means for vertically translating said platform between different levels in said automobile storage system and for vertically translating the platform through said entrance when said floor bolts are in said retracted position.

2. Apparatus in accordance with claim 1, wherein said elongated legs are vertical when said bolts are in said retracted position and are slanted when said bolts are in said extended position.

3. Apparatus in accordance with claim 1, wherein said bolts are fixed to a concrete slab.

* * * * *